US010619397B2

(12) United States Patent
Gregoriou

(10) Patent No.: US 10,619,397 B2
(45) Date of Patent: Apr. 14, 2020

(54) SYSTEM AND METHOD FOR SAFETY MANAGEMENT IN ROLL-UP DOORS

(71) Applicant: RYTEC CORPORATION, Jackson, WI (US)

(72) Inventor: Daniel Gregoriou, Kewaskum, WI (US)

(73) Assignee: RYTEC CORPORATION, Jackson, WI (US)

( * ) Notice: Subject to any disclaimer, the term of this patent is extended or adjusted under 35 U.S.C. 154(b) by 0 days.

(21) Appl. No.: 15/264,179

(22) Filed: Sep. 13, 2016

(65) Prior Publication Data

US 2017/0074039 A1 Mar. 16, 2017

Related U.S. Application Data

(60) Provisional application No. 62/218,328, filed on Sep. 14, 2015.

(51) Int. Cl.
*E05F 15/78* (2015.01)
*E05F 15/74* (2015.01)
(Continued)

(52) U.S. Cl.
CPC ..... *E05F 15/74* (2015.01); *E06B 9/68* (2013.01); *E05F 2015/765* (2015.01);
(Continued)

(58) Field of Classification Search
CPC ..... E06B 2009/6809; E06B 2009/6818; E06B 2009/6827; E06B 2009/6836; E06B 9/68; E05F 2015/765; E05F 15/78
(Continued)

(56) References Cited

U.S. PATENT DOCUMENTS 2,900,521 A * 8/1959 Eames ..... B66B 13/26 187/317
3,183,499 A * 5/1965 Cowen ..... G08B 13/183 250/208.4
(Continued)

FOREIGN PATENT DOCUMENTS

CN 205594802 9/2016
DE 10 2010 017398 12/2011
(Continued)

OTHER PUBLICATIONS

FlexiForce "Force LC2 safety light curtains manual," Aug. 18, 2014, Obtained from <http://www.flexiforce.com/issuu/cms/uploads/files/Downloads/E-Operators/force%20family/EN/10%20forceLC2%20EN.pdf>. (Year: 2014).*
(Continued)

*Primary Examiner* — Johnnie A. Shablack
(74) *Attorney, Agent, or Firm* — Schroeder Intellectual Property Law Group, LLC

(57) ABSTRACT

A safety curtain and system includes multiple light emitters and multiple light receivers to detect traffic approaching a doorway. The safety curtain my include pairs of multiple light emitters and receivers positioned on both sides of a passageway (doorway) so as to detect approaching traffic. The multiple light emitters and light receivers may detect a height of an approaching traffic (e.g., person or vehicle) and initiate warning lights of a possible door closing. The detected approach of traffic may cause the door to be stopped, reversed or slow down. The system may include a computer to monitor the signals from the receivers and may control the motion of the door.

18 Claims, 4 Drawing Sheets

(51) Int. Cl.
*E06B 9/68* (2006.01)
*E05F 15/73* (2015.01)

(52) U.S. Cl.
CPC ..... *E05Y 2400/44* (2013.01); *E05Y 2400/822* (2013.01); *E06B 2009/6836* (2013.01)

(58) Field of Classification Search
USPC ..... 160/7, 10, 1
See application file for complete search history.

(56) References Cited

U.S. PATENT DOCUMENTS 3,670,164 A * 6/1972 Hardy ..... G01T 1/178 250/366
3,746,863 A * 7/1973 Pronovost ..... G01V 8/20 250/208.4
3,805,061 A * 4/1974 De Missimy ..... F16P 3/144 250/208.3
4,029,176 A * 6/1977 Mills ..... B66B 13/26 187/317
4,266,124 A * 5/1981 Weber ..... F16P 3/144 250/221
4,452,009 A * 6/1984 Baumeler ..... B66B 13/26 187/317
4,853,531 A * 8/1989 Rejc ..... E05F 15/43 250/221
4,866,881 A * 9/1989 Morrow ..... G01S 13/862 49/25
4,894,952 A * 1/1990 Trett ..... B66B 13/26 49/25
4,914,859 A * 4/1990 Gionet ..... B66B 13/143 49/25
4,967,083 A * 10/1990 Kornbrekke ..... G01S 17/026 250/221
5,001,557 A * 3/1991 Begle ..... B66B 13/26 187/317
5,015,840 A * 5/1991 Blau ..... G01V 8/20 250/208.3
RE33,668 E * 8/1991 Gray ..... B66B 13/26 187/317
5,149,921 A * 9/1992 Picado ..... B66B 13/26 187/317
5,193,895 A 3/1993 Naruke et al.
5,225,689 A * 7/1993 Buckle ..... G01S 17/87 250/221
5,302,942 A 4/1994 Blau
5,410,149 A * 4/1995 Winston, Jr. ..... B66B 13/26 250/221
5,428,923 A 7/1995 Waggamon
5,641,951 A * 6/1997 Cai ..... B66B 13/26 187/317
5,925,858 A * 7/1999 Full ..... B66B 13/26 187/317
5,929,580 A 7/1999 Mullet et al.
5,969,637 A 10/1999 Doppelt et al.
6,167,991 B1 * 1/2001 Full ..... B66B 13/26 187/317
6,243,006 B1 6/2001 Rejc et al.
6,292,100 B1 9/2001 Dowling
6,304,178 B1 * 10/2001 Hayashida ..... G01V 8/10 340/545.1
6,354,716 B1 * 3/2002 Chen ..... G01V 8/22 250/221
6,678,999 B2 * 1/2004 Zengguang ..... G01S 17/026 49/25
6,737,968 B1 * 5/2004 Ergun ..... G07C 9/00182 340/12.54
6,756,910 B2 * 6/2004 Ohba ..... G01V 8/10 318/286
6,782,660 B2 * 8/2004 Takada ..... E05F 15/74 49/25
6,812,837 B2 11/2004 Ikeuchi
6,970,085 B2 * 11/2005 Okabe ..... E05F 15/43 340/480
7,044,271 B2 * 5/2006 De Coi ..... B66B 13/26 187/316
7,045,764 B2 * 5/2006 Beggs ..... E06B 9/13 250/221
7,048,422 B1 5/2006 Solomon
7,064,666 B2 * 6/2006 Sasaki ..... G01S 13/04 250/221
7,071,459 B2 * 7/2006 Pustelniak ..... B66B 13/26 250/221
7,084,388 B2 8/2006 Rejc
7,140,469 B2 * 11/2006 Deplazes ..... B66B 1/3476 187/316
7,154,112 B2 * 12/2006 Eubelen ..... G01S 7/481 250/559.31
7,161,319 B2 * 1/2007 Ergun ..... G07C 9/00182 318/15
7,253,890 B2 8/2007 Miremadi
7,380,375 B2 * 6/2008 Maly ..... B65G 69/2882 340/524
7,495,556 B2 * 2/2009 Eubelen ..... E05F 15/43 340/545.1
7,533,431 B2 5/2009 Hochstein et al.
7,762,304 B2 * 7/2010 La Marca ..... E06B 9/88 160/1
7,771,080 B2 8/2010 Platt
7,900,398 B2 * 3/2011 Liles, Jr. ..... E05G 5/003 49/25
7,940,300 B2 * 5/2011 Spinelli ..... H04N 7/183 348/143
8,077,034 B2 * 12/2011 Borlez ..... G08B 13/196 340/5.7
8,115,162 B2 * 2/2012 Shikai ..... B66B 13/26 250/221
8,145,351 B2 * 3/2012 Schininger ..... E05G 1/06 221/12
8,309,904 B2 * 11/2012 De Coi ..... E06B 9/88 250/222.1
8,445,833 B2 * 5/2013 Klingelhofer ..... G01V 8/20 250/214 DC
8,547,234 B2 * 10/2013 Maly ..... B65G 69/2882 14/6
8,575,538 B2 * 11/2013 De Coi ..... E06B 9/88 250/222.1
8,791,839 B2 * 7/2014 Citta ..... G01S 7/527 340/518
8,833,524 B2 * 9/2014 De Coi ..... B66B 13/26 187/316
8,867,045 B2 * 10/2014 Piana ..... G01V 8/20 356/614
8,875,441 B2 * 11/2014 Agam ..... G01S 7/527 49/26
8,904,708 B2 * 12/2014 Zacchio ..... B66B 13/26 49/25
8,988,213 B2 * 3/2015 Leutenegger ..... E06B 9/88 250/222.1
9,057,779 B2 * 6/2015 Pfiffner ..... E06B 9/88
9,163,446 B2 10/2015 Houser et al.
9,292,136 B2 * 3/2016 Pratt ..... G06F 3/0425
9,341,013 B2 * 5/2016 Iwata ..... E05F 15/73
9,503,184 B2 * 11/2016 Grimm ..... G01V 8/20
9,528,312 B2 * 12/2016 Shimazu ..... G01S 7/51
9,671,523 B2 * 6/2017 Gelineau ..... F16P 3/144
9,771,225 B2 * 9/2017 Stone ..... B65G 69/00
9,797,184 B2 * 10/2017 Collins ..... E05F 15/78
9,830,825 B2 * 11/2017 Anstett ..... G08G 1/168
9,926,148 B2 3/2018 Hochstein et al.
9,970,230 B2 * 5/2018 Scholten ..... E05F 15/74
10,087,049 B2 * 10/2018 Collins ..... B66B 13/26
2005/0103577 A1 * 5/2005 Warner ..... B66B 13/26 187/317
2006/0022596 A1 2/2006 Watanabe et al.
2006/0162254 A1 * 7/2006 Imai ..... E05F 15/73 49/26
2008/0022596 A1 * 1/2008 Boerger ..... E06B 9/82 49/31

(56) References Cited

U.S. PATENT DOCUMENTS

2010/0037522 A1* 2/2010 Wirth ..... E06B 3/80 49/31
2010/0162629 A1* 7/2010 Wirth ..... E06B 3/80 49/360
2010/0309007 A1 12/2010 Goldsmith
2010/0319256 A1* 12/2010 Agam ..... G01S 15/04 49/31
2011/0203059 A1 8/2011 Whitley et al.
2011/0284171 A1* 11/2011 Daniele ..... G01S 13/04 160/10
2013/0062511 A1* 3/2013 De Coi ..... E06B 9/88 250/222.1
2015/0315834 A1* 11/2015 Collins ..... E05F 15/78 49/26
2016/0040469 A1* 2/2016 Lietz ..... E05F 15/668 49/13
2016/0047159 A1* 2/2016 Scholten ..... E05F 15/74 700/275
2016/0284175 A1 9/2016 Finn et al.
2016/0298373 A1* 10/2016 Lietz ..... E05F 15/668
2016/0348429 A1* 12/2016 Frede ..... E06B 9/88
2016/0348430 A1* 12/2016 Lorenzani ..... E06B 9/13
2016/0376843 A1* 12/2016 Schneider ..... E06B 9/11 318/16
2017/0138111 A1* 5/2017 Lietz ..... E05F 15/70
2017/0254141 A1* 9/2017 Iglesias Ballester ... E06B 35/00
2017/0306696 A1* 10/2017 Slupik ..... H02P 25/04
2017/0314314 A1* 11/2017 Collins ..... E05F 15/43
2017/0315262 A1* 11/2017 Collins ..... G01V 8/20
2018/0002980 A1* 1/2018 Bartole ..... E06B 9/68
2018/0209198 A1* 7/2018 Company ..... B66B 13/26

FOREIGN PATENT DOCUMENTS

EP 0598630 B1 3/1997
EP 1626924 A2 2/2006
EP 2 256 277 12/2010
EP 2292548 A1 3/2011
EP 2 374 985 10/2011
WO 2014/147292 A1 9/2014
WO 2015/000622 1/2015
WO 2016/022534 2/2016
WO 2016/029246 3/2016

OTHER PUBLICATIONS

International Search Report issued in related co-pending PCT/US2016/051721 dated Nov. 17, 2016.
Extended European Search Report for related EP App. No. 16 847 226.4 dated Apr. 18, 2019, 7 pages.

* cited by examiner

SYSTEM AND METHOD FOR SAFETY MANAGEMENT IN ROLL-UP DOORS

CROSS-REFERENCE TO RELATED APPLICATIONS

This application claims benefit and priority to U.S. Provisional Application No. 62/218,328 filed Sep. 14, 2015, the disclosure of which is incorporated by reference herein in its entirety.

BACKGROUND 1.0 Field of the Invention

The present disclosure relates to a system and a method for safety management for doors and, more particularly, a system and a method for safety management in roll-up doors that provides improved detection of traffic therethrough and improved control of the motion of the door, among other features.

2.0 Related Art

Currently, door assemblies and/or window assemblies, such as, e.g., for a high performance door used in commercial applications or a garage door, are often constructed with sensors to detect motion or cause a state change of the door or window. High performance roll-up type doors may be provided with two sets of photo electric single beam sensors (aka "photo eyes") as a standard feature, perhaps as a separate LED warning light. A "set" of photo eyes may include a single beam emitter and receiver pair. Generally, the sensor may react when the light beam between the emitter and receiver is blocked or broken. One set of photo eyes may be located on each side of a door opening. In some applications, the photo eyes may be installed at the factory and may have a fixed position and distance from the moving portion of the door. Alternatively, one or both of the provided photo eyes may be shipped separately or uninstalled with brackets for field installed in accordance with the installation instructions provided.

A "set" of photo eyes that includes a single beam emitter and receiver pair has significant limitations and capabilities. A system that improves on this would be a welcomed addition to safety systems for doors.

SUMMARY OF THE DISCLOSURE

In one aspect, a door safety system is provided that comprises a light curtain comprising at least one light emitting device and at least one light receiver device, the light emitter device comprising a plurality of light emitters, the at least one light receiving device comprising a plurality of light detectors for detecting a presence or a lack of presence of one or more of the plurality of beams from the plurality of light emitters, and either or both of the light emitter device and the at least one light receiving device comprising at least one warning light for providing visual warning of movement of a door. The door safety system may further comprise a computer configured to receive at least one signal from the at least on light receiving device, the at least one signal conveying a status of at least one of the plurality of beams. The computer may be further configured to control movement of the door based on the at least one signal. The computer may be configured to determine a height or size of traffic between the light emitter device and the at least one light receiving device based on the at least one signal. The computer may be configured to determine a speed for controlling movement of the door. The computer may be configured to determine a direction of movement of the door. The computer may be configured to stop, reverse or start movement of the door based on the at least one signal. The computer may be configured to control the at least one warning light based on the at least one signal. The computer may be configured to control a pattern of color or flash rate of the at least one warning light. The at least one warning light may comprise a plurality of warning lights and the pattern may be produced across the plurality of warning lights so that plurality of warning lights have different colors, or are activated at different times from each other.

In one aspect, a method for providing a door safety system is provided including providing two light curtains on either side of a centerline of a door, each light curtain comprising: at least one light emitting device and at least one light receiver device, the light emitter device comprising a plurality of light emitters, the at least one light receiving device comprising a plurality of light detectors configured to detect a presence or a lack of presence of one or more of the plurality of beams from the plurality of light emitters, and either or both of the light emitter device and the at least one light receiving device comprising at least one warning light for providing visual warning of movement of a door, and controlling motion of the door and controlling the at least one warning light based on the detected presence or lack of presence of the one or more plurality of beams. The light curtains on either side of a centerline of a door may be separate and spaced apart from the door. The controlled motion of the door may include stopping, reversing or starting movement of the door based on the at least one signal. The step of controlling motion may be based on a determined height of an object passing between the at least one light emitting device and the at least one light receiver device. The step of controlling motion may be based on the determined height, the determined height being a number of blocked beams in a vertical plane between the at least one light emitting device and the at least one light receiver device. The controlling of the at least one warning light may include changing a color of the at least one warning light. The at least one warning light may comprise a plurality of warning lights and the plurality of warning lights may be controlled to change color, change a flash rate or to produce a pattern across the plurality of warning lights based on the detected presence or lack of presence of the one or more plurality of beams. The controlling the at least one warning light may indicate that the door is about to close or is closing. The step of controlling motion of the door may include determining a speed of the door from among multiple possible speeds based on the at least one signal.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

Figure 1A:
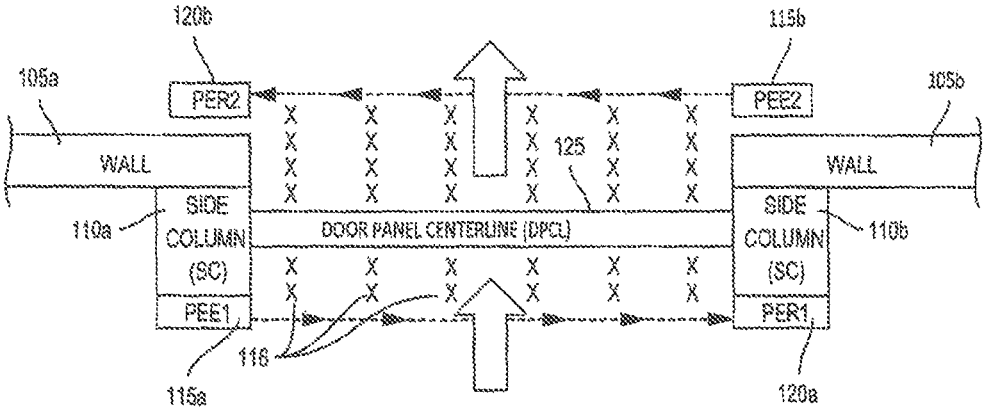
FIG. 1A PRIOR ART
FIG. 1A is a plan view of an example safety system, configured according to the prior art.

The present disclosure is further described in the detailed description that follows.

DETAILED DESCRIPTION OF THE DISCLOSURE

The disclosure and the various features and advantageous details thereof are explained more fully with reference to the non-limiting examples that are described and/or illustrated in the accompanying drawings and detailed in the following description and attachment. It should be noted that the features illustrated in the drawings are not necessarily drawn to scale, and features of one example may be employed with other examples as the skilled artisan would recognize, even if not explicitly stated herein. Descriptions of well-known components and processing techniques may be omitted so as to not unnecessarily obscure the examples of the disclosure. The examples used herein are intended merely to facilitate an understanding of ways in which the invention may be practiced and to further enable those of skill in the art to practice the examples of the disclosure. Accordingly, the examples herein should not be construed as limiting the scope of the invention.

The terms "including", "comprising" and variations thereof, as used in this disclosure, mean "including, but not limited to", unless expressly specified otherwise.

The terms "a", "an", and "the", as used in this disclosure, means "one or more", unless expressly specified otherwise. The term "about" means within plus or minus 10%, unless context indicates otherwise.

Devices that are in communication with each other need not be in continuous communication with each other, unless expressly specified otherwise. In addition, devices that are in communication with each other may communicate directly or indirectly through one or more intermediaries.

Although process steps, method steps, algorithms, or the like, may be described in a sequential order, such processes, methods and algorithms may be configured to work in alternate orders. In other words, any sequence or order of steps that may be described does not necessarily indicate a requirement that the steps be performed in that order. The steps of the processes, methods or algorithms described herein may be performed in any order practical. Further, some steps may be performed simultaneously.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device may be alternatively embodied by one or more other devices which are not explicitly described as having such functionality or features.

Figure 1B:
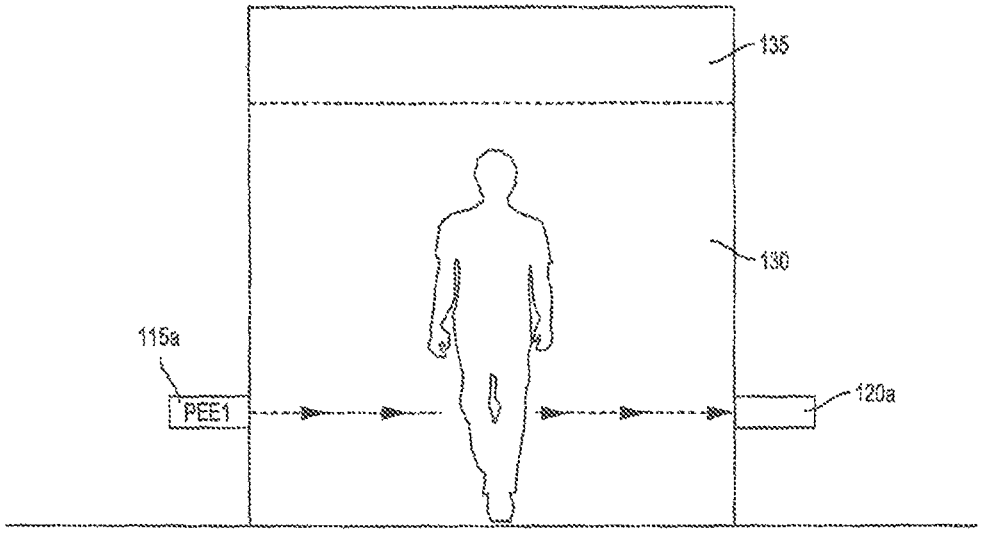
FIG. 1B PRIOR ART
FIG. 1B is a side view of an example of a typical safety system, configured according to the prior art.

FIG. 1A and FIG. 1B shows a roll-up type door 135 configured with the traditional two sets of photo electric single beam sensors (aka "photo eyes"); the first sensor set comprising photo electric emitter 115*a* and photo electric receiver 120*a*; the second sensor set comprising photo electric emitter 115*b* and photo electric receiver 120*b*. Separate LED warning light strips may also be provided (not shown). Each "set" of photo eyes may consist of a single beam emitter and receiver pair. Generally, one or more of the sensor sets react when the light beam between the emitter 115 and receiver 120 is blocked or broken.

One set of photo eyes is typically located on each side of a door opening formed between side columns 110*a*, 110*b*. The structural side columns 110*a*, 110*b* are typically associated with a respective wall section 105*a*, 105*b*. The photo eyes may be installed at the factory and may have a fixed position and distance from the moving portion of the door 135. On some models, one or both of the provided photo eyes may be shipped loosely with brackets for field installation in accordance with the installation instructions provided. At least one pair and as many as two pair of LED warning lights, depending on model, may be provided (not shown). A "pair" of LED warning lights 116 typically comprises two strips approximately 36" long. The warning lights may be installed in a similar way as the beams, depending on the door model, relative to some being factory installed and some field installed or a combination of field and factory. The position of the warning lights may be positioned so that any traffic approaching the opening would be provided advanced notice that the door 135 is about to close or is closing via the LED lights 116 in yellow or red colors and flashing or steady states.

Typically, the position of the photo eye beam line (i.e., a photo beam created between an emitter 115 and a receiver 120) may be placed in parallel and as near to the movable door 135 (when closed) or the centerline 125, as is practical. The positioning of the photo eyes in this way is intended to minimize the distance of area between photo eye beams to more immediately identify traffic that may be directly in the downward path of the door 135. In the case of field installed beams, several factors create unavoidable variation in the location of the beams relative to the distance from the door 135 such as a thickness of the wall section 105*a*, 105*b* or construction materials, site obstructions, etc. These variations can result in photo eye beam placement as much as 18-24" from the centerline 125 and may allow traffic to be in the downward path of the door 135, potentially without detection. In situations such as these, a reversing edge system becomes the primary safety sensing device rather than the photo eye beams. The reversing edge system functions only after the edge sensing strip (not shown) located along the leading (i.e., lower) edge of the door 135 comes in contact with the traffic in or passing through the doorway 130.

In order to better explain the benefits of the various novel aspects of the present disclosure, a general description of a typical automatic cycle of a high performance door (such as, e.g., a Rytec Corporation high performance door) is first provided. In applications, the door may be a roll-up door, but may also be other types of doors such as laterally moving doors, panel doors or the like.

A high performance door movement typically begins with the door 135 in the closed position and starts with an automatic activation (aka activator). The activator device is intended to indicate to a door controller (not shown) that the traffic intends to pass through the doorway 130. The activator (not shown) is typically a hands free device that does not require direct human interface or contact. These devices vary in type, placement and ability to sense oncoming traffic. The speed of the approaching traffic towards the door typically dictates the sensing distance necessary for clear passage through the door opening. Because of these variations, the traffic in the door area can be detected but not necessarily when it's very near the door 135. The activator signals an input on the controller that results in the door 135 being driven to the open position at its set maximum speed, typically 45 to 100 inches per second depending on model. Additionally, an activator signal may return a door in the process of a closing move to the open position, and an open door would be held in the open position whenever the activator senses traffic.

After activation and an opening move, the door 135 may come to rest in the full open position. If the activator sensors have cleared (i.e., no traffic is recognized) and the photo eye beams are uninterrupted, the door would begin a user defined timed countdown. At the expiration of the timed countdown, the warning light strips 116 may begin flashing yellow for a user defined amount of time as a pre-announcement to the traffic that the door will begin the closing process soon. At the expiration of the flashing yellow signal, the warning lights 116 may change to a steady or solid red color as an announcement that the door is beginning the closing move and traffic should not proceed. The door closes automatically at the predetermined speed. For a high performance door the closing speed is typically 20-36" per second depending on model. During closing, the warning lights 116 typically remain red and on steady until the door reaches the closed position.

If at any point in the previously described sequence the beam of either photo eye was blocked or interrupted; a door still in the open position would return to the beginning of the sequence described above; if either beam remained blocked, the sequence would be held at the beginning of the sequence described above; if the door were executing a closing movement the controller would immediately reverse the direction of the door and return to the open position until which time the beams are unobstructed.

Figure 2A:
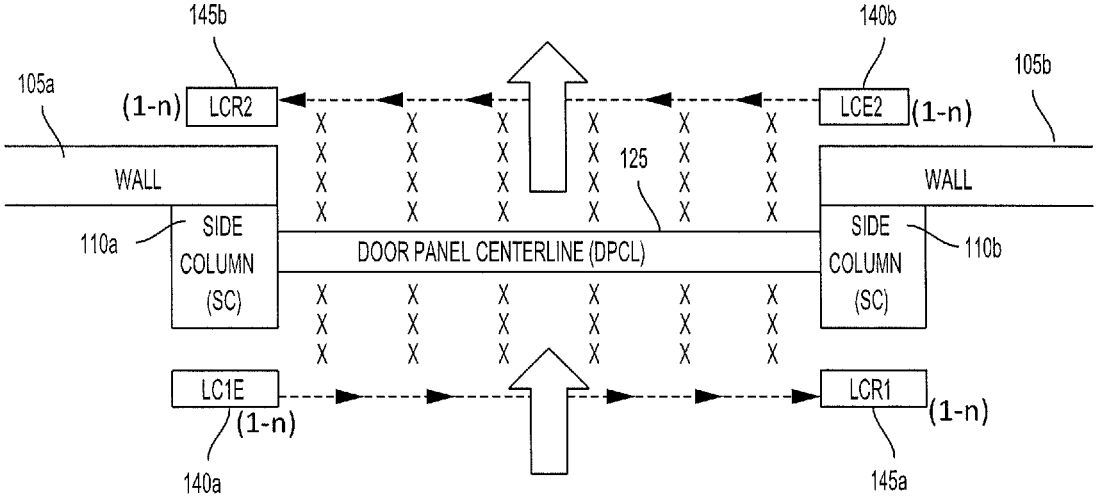
FIG. 2A is a plan view of an example safety system, according to principles of the disclosure.
Figure 2B:
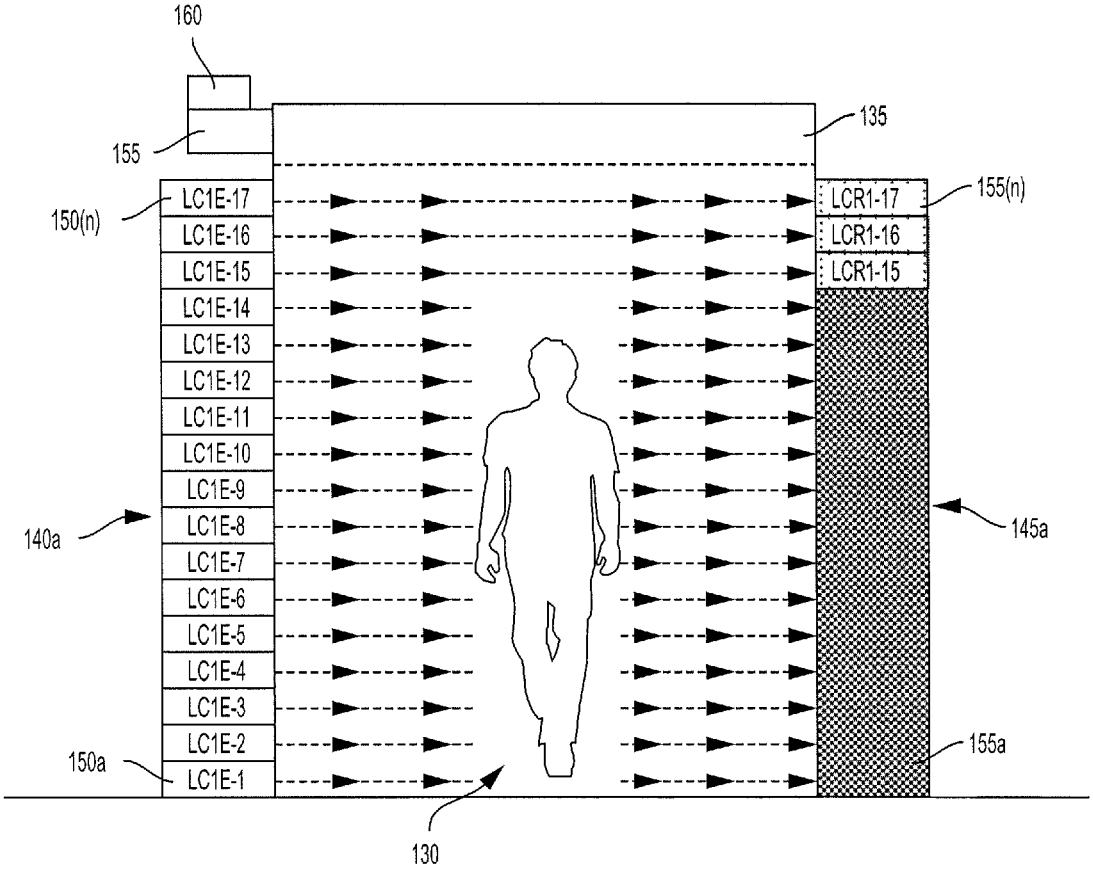
FIG. 2B is a side view of an example safety system, according to principles of the disclosure.
Figure 4:
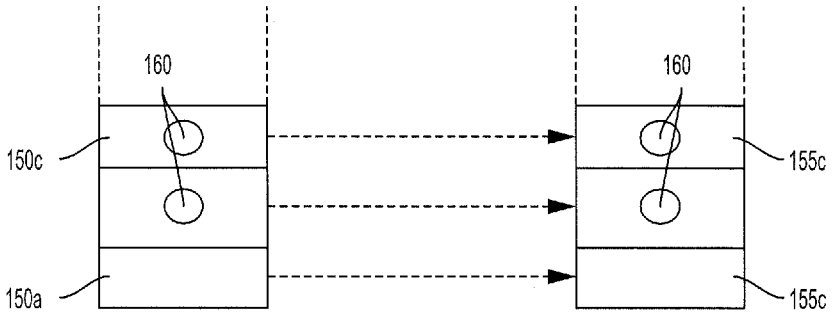
FIG. 4 is a block diagram of a combined light curtain device and warning devices, configured according to principles of the disclosure.

In further advancement of the above techniques, FIG. 2A is a plan view of an example safety system and FIG. 2B is a side view of an example safety system, according to principles of the disclosure. FIGS. 2A and 2B illustrate two "sets" of photo electric beam array sets (aka light curtains). The sets may be positioned proximate a respective wall section 105*a*, 105*b* or side columns 110*a*, 110*b* that may support the door 135. The first set of photo electric beam array sets comprises a light curtain emitter 140*a* and a light curtain receiver 145*a*. The second set comprises a light curtain emitter 140*b* and a light curtain receiver 145*b*. Each light curtain set (140*a*/145*a* and 140*b*/145*b*) comprises a plurality of light emitters 150*a*-150*n* that are each configured to emit a photo electric beam to a plurality of light receivers 155*a*-155*n*. Each light curtain device (140*a*, 140*b*, 145*a* and/or 145*b*) may also include an integrated system of multi-colored LED lights 160 (FIG. 4) thereby combining a sensor (or emitter) and warning devices (light warning devices) in a single unit set, as shown in FIG. 4. A light curtain set (140*a*/145*a* and 140*b*/145*b*) may be configured with warning lights of a single or different colors and types of lights, preferably LEDs. In different applications, the number of warning lights 160 may vary for each light curtain set (140*a*/145*a* and 140*b*/145*b*).

At least one set of light curtains (e.g., 140*a*/145*a*, 140*b*/145*b*) may be installed on each side of a doorway parallel with the moving part of the door panel, i.e., parallel to the centerline 125. In some applications, more than one set of light curtains (e.g., 140*a*/145*a*, 140*b*/145*b*) may be installed on each side of the doorway. Relative to location, one significant benefit of this design is that the system does not rely on a close proximity of each light curtain, relative to the moving part of the door 135, to determine if traffic may be in or near the downward path of the moving door panel.

A light curtain component may include a series of LED-type multi-colored lights that serve in a similar fashion to that previously described above. The enhanced design may offer improved visibility, more luminaries, higher intensity and expanded capability.

Figure 3:
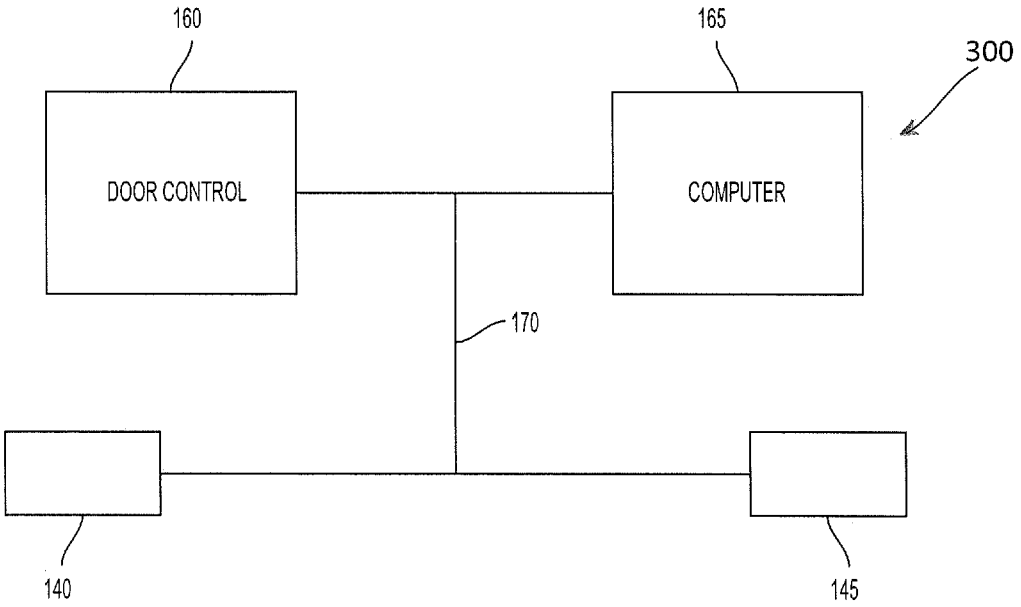
FIG. 3 is an illustration of an example system, configured according to principles of the disclosure.

FIG. 3 is a block diagram of an example system, configured according to principles of the disclosure. The system 300 may include a computer 165 (or controller) for receiving or sending signals from the emitters 140 and the receivers 145. The computer 165 may be configured to control a door controller 160. The door controller 160 may be configured for starting movement, stopping movement, selecting direction of the door 135, and/or selecting a speed for motion of the door 135. The computer 165 may be connected by a communications link 170 to one or more (or all) of the door controller 160, the one or more emitters 140 and the one or more receivers 145, the warning lights 160 and a door controller 160. The computerized controller 165 as the central intelligence for the improved light curtain system 300, and in conjunction with the combined light curtain design (combined warning lights 160 and curtain emitter 140*a* or light curtain receiver 145*a* and warning lights 160), the system can analyze and react in a variety of ways to variations in the traffic flow through and around the doorway. The computer 165 may also log an event, and/or may communicate an alert to a remote station, perhaps over a network, if a parameter indicates that detected motion is not expected, such as, e.g., after hours.

Based on utilizing the individual signals from each of the numerous beams of each light curtain set (e.g., 140*a*/145*a*, 140*b*/145*b*), comparative analysis of each set unto themselves and to each other can be processed by the system controller 165. Analytics such as which particular beam or beams are blocked, how many beams are blocked in a vertical plane, blocked beam patterns and equality, blocked time duration, etc., may be performed by the controller 165 and may produce numerous variations in door function, sequence and control. The controller 165 may determine the height of a passing object or person (generically "traffic") through the doorway 130 based on the state of the beams from one or more light curtain sets (e.g., 140*a*/145*a*, 140*b*/145*b*). For example, based on the determined height, width and/or overall size, a determination may be made as to whether or not a door 135 may be slowed (or not) and by how much, or whether the door should be stopped or reversed. That is, a suitable speed of the door may be computed from among multiple possible speeds. A decision may be dynamically made to determine if the door 135 direction must be reversed, and perhaps how fast the reversal must occur and speed of the door to move to prevent a possible mishap.

The computer 165 may be configured with a memory and/or a database and may have user programmable parameters predefined. For example, an end user may select how the door and the system 300 react to variations in analytical results through pre-defined parameterization. Examples of variations from normal timing, warning and door speeds may include:

i) Timing:

User-defined times such as the countdown to pre-close warning; duration of LED yellow warning before closing and duration of LED solid red signal may be extended based on defined analytical outcome.

ii) LED warning lights:

a) Times, colors and flashing frequency may be altered based on various defined analytical outcome.

b) LED warning: Yellow lights could flash at a higher frequency as soon as an unusual traffic pattern is detected thereby drawing the traffic's attention to the automatic door. More natural traffic patterns would result in a normal and shorter cycle of events.

c) LED warning: Red lights duration could begin with a slow flash then a higher frequency flash before changing to solid red so as to more deliberately alert the traffic that the door is about to close. More natural traffic patterns would result in a normal and shorter cycle of events.

iii) Door closing speed:

Reduction in the door closing speed would be executed when the controller determines that the traffic did not pass through the doorway in a normal fashion. Through the comparative analysis, lingering traffic could result in the door being held open in "secure mode" or the closing speed reduced to "slow mode" of speeds less than 12" per second. Tall doors could be set to close at normal speed until the door reaches just above the "traffic height" and then reduced to "slow speed." A slow speed close may allow the traffic additional time to exit the guarded area. The reversing edge system would then function as the primary safety.

The improved safety concept offers the ability to define a space around the downward moving part of the door. Additionally, the distance of the safety curtain from the downward moving part of the door can be increased as the system may recognize traffic that is in or may be near the now guarded area. The system 300 may allow the light curtains to be placed advantageously and without concession relative to the distance from the downward moving parts of the door. No longer is it necessary to place the beams in close proximity so as to detect traffic under the door. The extended distance allows for the advanced notice for need of reversal of a closing door 135 before the point of intersect between the downward moving parts of the door and the traffic through the doorway.

In any case where the controller is unsure or the analytics are unclear, the door could be held open, or close in "slow mode," at a user's discretion, through adjustable configurations (parameters).

A similar concept may be applied to existing doors equipped with only single beam photo eyes and controller 165. With significantly less analytical information available through these single beam devices, the resulting outcome may likely be more frequent "slow closing" movements but still an improvement in defining the guarded area. Again, the variations in the distance between the field installed photo eyes and the downward moving part of the door may become a non-issue. With backwards compatibility through software upgrade, existing computer controlled doors may benefit from the full or limited design concept with relative ease. A USB port associate with computer 165 (or other I/O port) may allow software upgrade and predetermined formatting of associated parameters.

FIG. 4 is a block diagram of a combined light curtain device and warning devices, configured according to principles of the disclosure. Each light curtain device (140*a*, 140*b*, 145*a* and/or 145*b*) may also include an integrated system of multi-colored lights 160 (FIG. 4) thereby combining a sensor (or emitter) and warning devices (light warning devices) in a single unit set, as shown in FIG. 4. A light curtain set (140*a*/145*a* and 140*b*/145*b*) may be configured with warning lights 160 of a single or different colors and types of lights, preferably LEDs, but other types of lights may be utilized. In different applications, the number of warning lights 160 may vary for each light curtain set (140*a*/145*a* and 140*b*/145*b*). The warning lights 160 may be controlled by computer 165. The computer 165 may output a selected pattern based on the detected object approaching the door. The computer 165 may vary the flash rate of the warning lights 160 based on speed of the detected object.

In some applications multiple light curtain sets (140*a*/145*a* and 140*b*/145*b*) may be positioned on each side of the centerline 125, spaced apart from one another. In this way, an even earlier detection of motion of an approaching object to the door 135 may be achieved and also a direction of the object passing between the light curtain sets (140*a*/145*a* and 140*b*/145*b*) may be even more quickly known. For example, it may be determined whether or not the object has stopped and reversed direction while proximate the centerline 125. This may be promptly detected and the computer 165 may determine and cause a new course of action (e.g., changing speed of the door, changing direction of the door, changing a pattern of the warning lights, or the like) based on a new direction or activity of the object within the detection zone of multiple light curtain sets (140*a*/145*a* and 140*b*/145*b*) on each side of the centerline 125.

Figure 5:
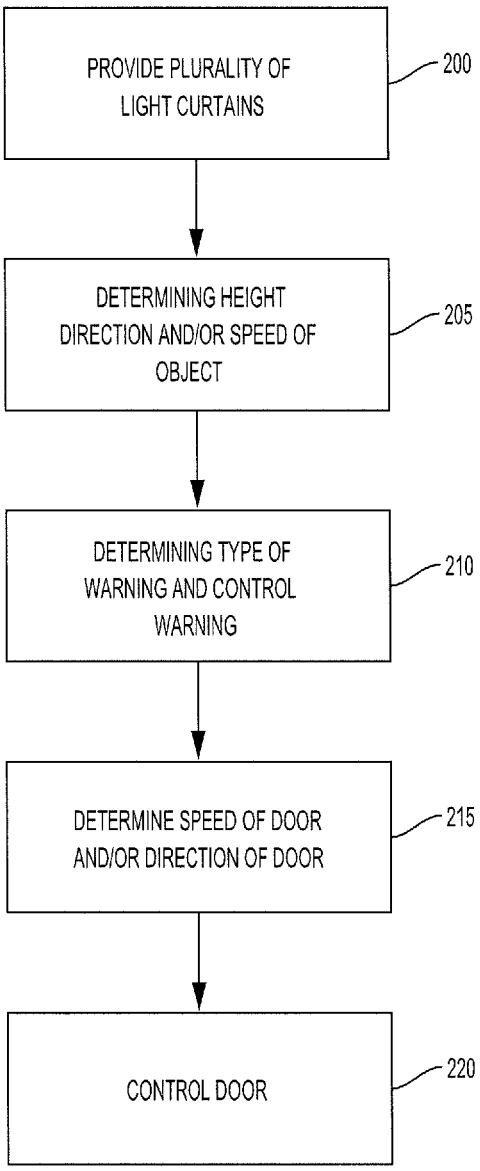
FIG. 5 is an example process of using a safety system, the steps preformed according to principles of the disclosure.

FIG. 5 is an example process of using a safety system, the steps performed according to principles of the disclosure. At step 200, a plurality of light curtains (e.g., 140*a*/145*a*, 140*b*/145*b*) may be provided and positioned proximate a door passageway on either side of a centerline of the door. Based on one or more received signals from the plurality of light curtains, a height of an object passing between the plurality of light curtains may be determined. The speed of the movement of the object may also be determined. Based on the results of step 205, at step 210 a type of warning may be determined such as, e.g., a light pattern of warning lights, a color of warning lights or a pattern of colors, audible alert and/or flash rates of the warning lights. At step 215, the speed of a door and/or the direction (i.e., to open or close) may be determined. The speed of a door and/or the direction (i.e., to open or close) may be based on the results of step 205. At step 220, the door may be controlled as determined at step 215 and the warning lights may be controlled as determined previously.

While the invention has been described in terms of examples, those skilled in the art will recognize that the invention can be practiced with modifications in the spirit and scope of the appended claims. These examples are merely illustrative and are not meant to be an exhaustive list of all possible designs, embodiments, applications or modifications of the invention.

What is claimed:

1. A door and door safety system comprising:

a door having a door panel for selectively permitting and prohibiting access to a door opening;

a first light curtain set comprising a first light emitting device and a first light receiving device, the first light emitting device comprising a first plurality of light emitters and the first light receiving device comprising a first plurality of light detectors, the first plurality of light detectors being configured to receive and detect a first plurality of light beams emitted by the first plurality of light emitters;

at least one first warning light, the at least one first warning light being coupled to at least one of the first light emitting device or the first light receiving device;

a second light curtain set comprising a second light emitting device and a second light receiving device, the second light emitting device comprising a second plurality of light emitters and the second light receiving device comprising a second plurality of light detectors, the second plurality of light detectors being configured to receive and detect a second plurality of light beams emitted by the second plurality of light emitters;

at least one second warning light, the at least one second warning light being coupled to at least one of the second light emitting device or the second light receiving device, wherein the first light curtain set is configured on a first side the door opening and the at least one first warning light being coupled to at least one of the first light emitting device or the first light receiving device so that the at least one first warning light is visible when approaching the first side of the door opening, and the second light curtain set is configured on a second side the door opening, and the at least one second warning light being coupled to at least one of the second light emitting device or the second light receiving device so that the at least one second warning light is visible when approaching the second side of the door opening.

2. The door and door system of claim 1, wherein the first light emitting device and the first light receiving device extend vertically proximate the first side of the door opening and are separated by a first distance, and the second light emitting device and the second light receiving device extend vertically proximate the second side of the door opening and are separated by a second distance, the first distance and the second distance being equal to or greater than a width of the door opening.

3. The door and door system of claim 1 further comprising:

a controller connected to the first light receiving device and the second light receiving device, the controller being configured to receive a first signal from the first light receiving device conveying a first status, the first status indicating whether all, less than all or none of the first plurality of beams are being received by the first light receiving device, and a second signal from the second light receiving device conveying a second status, the second status indicating whether all, less than all or none of the second plurality of beams are being received by the second light receiving device.

4. The door and door system of claim 3 wherein the controller outputs at least one control signal, the at least one control signal being generated based upon the first status and the second status received from the first light receiving device and the second light receiving device, respectively.

5. The door and door system of claim 4 wherein the at least one control signal output by the controller controls an operating status of the door.

6. The door and door system of claim 5 wherein the operating status controlled by the at least one control signal is one or more from the group consisting of: opening the door, stopping the door, closing the door, slowing down the door, speeding up the door, or reversing the direction of the door.

7. The door and door system of claim 6 wherein the controller determines a size of traffic when at least one of the first status or the second status indicates that less than all of the first plurality of beams or second plurality of beams are received, wherein the controller outputs the at least one control signal based on the size of the traffic determined by the controller.

8. The door and door system of claim 7 wherein the controller is connected to the at least one first warning light and the at least one second warning light, wherein the controller outputs at least a second control signal which causes the at least one first warning light or the at least one second warning light to illuminate, wherein the second control signal causes the at least one first warning light and/or the at least one second warning light on the opposite side of the first light receiving device or the second light receiving device to output a status which indicates that less than all of the plurality of beams is being received.

9. The door and door system of claim 8 wherein the controller continues to output at least the second control signal if traffic lingers between the first receiving device and the second light receiving device.

10. The door and door system of claim 3 wherein the controller is connected to the at least one first warning light and the at least one second warning light, and the controller outputs at least one control signal which causes one or more of the at least first warning light or the at least second warning light to illuminate.

11. The door and door system of claim 10 wherein the controller outputs the at least one control signal to each of at least one first warning light and the at least one second warning light to indicate that the door is about to close.

12. The door and door system of claim 11 wherein the controller outputs the at least a second control signal to each of at least one first warning light and the at least one second warning light to indicate that the door is closing, the second control signal causing each of at least one first warning light and the at least one second warning light to change an operating status.

13. The door and door system of claim 12 wherein the operating status change is one or more from the group consisting of: causing one or more of the at least one first warning light or the at least one second warning light to blink; causing one or more of the at least one first warning light or the at least one second warning light to blink at a different speed; causing one or more of the at least one first warning light or the at least one second warning light to change color; or causing one or more of the at least one first warning light or the at least one second warning light to turn on in a different pattern.

14. A method of controlling a door and providing door safety, the method comprising the steps of:

providing a door which can be opened and closed to selectively permit and prohibit access to a door opening;

detecting traffic proximate a first side of the door opening using a first light curtain;

detecting traffic proximate a second side of the door opening using a second light curtain;

determining a height of all traffic approaching the door opening detected by the first light curtain or the second light curtain;

controlling operation of the door based on the detection of traffic by the first and second light curtains;

stopping operation of the door while traffic lingers between the first light curtain and the second light curtain until traffic matching the height of all detected traffic sensed by the first light curtain or the second light curtain has exited the area between light curtains; and providing an indicator warning if traffic is detected by one or more of the first light curtain or the second light curtain.

15. The method of claim 14 further comprising the step of providing an indicator warning if an operating status of the door is about to change.

16. The method of claim 14 wherein detection of traffic by one or more of the first light curtain or the second light curtain causes the operation of the door to controlled by one or more from the group consisting of: opening the door, closing the door, starting the door, stopping the door, reversing the door, slowing the door down or moving the door faster.

17. The method of claim 14 further comprising the step of programming a controller which controls the operation of the door, the controller being programmed to control operation of the door based on detection of traffic by one or more of the first light curtain or the second light curtain.

18. The method of claim 17 wherein the controller is programmed with one or more operating parameters, the door controller controlling the operation of the door using the operating parameters and selecting a mode of operation for the door based from the operating parameters based upon detection of traffic by one or more of the first light curtain or the second light curtain.

* * * * *